United States Patent [19]

Anderson et al.

[11] Patent Number: 4,780,150

[45] Date of Patent: Oct. 25, 1988

[54] CORROSION INHIBITED ACID CLEANERS

[75] Inventors: James D. Anderson, Ft. Washington; Sandra K. Seigle, Norristown, both of Pa.

[73] Assignee: Amchem Products, Inc., Ambler, Pa.

[21] Appl. No.: 18,764

[22] Filed: Mar. 2, 1987

Related U.S. Application Data

[63] Continuation of Ser. No. 827,664, Feb. 7, 1986, abandoned, which is a continuation of Ser. No. 486,527, , abandoned.

[51] Int. Cl.[4] ..... C23G 1/06

[52] U.S. Cl. ..... 134/3; 134/41; 252/87; 252/148

[58] Field of Search ..... 134/3, 41; 252/82, 87, 252/148; 422/12, 16

[56] References Cited

U.S. PATENT DOCUMENTS

| | | | |
|---|---|---|---|
| 3,505,184 | 4/1970 | Schaedler | 204/55 R |
| 4,209,418 | 6/1980 | Anderson | 252/148 |

FOREIGN PATENT DOCUMENTS

| | | |
|---|---|---|
| 49-035244 | 1/1974 | Japan . |
| 7435244 | 4/1974 | Japan . |
| 1052771 | 12/1966 | United Kingdom . |

OTHER PUBLICATIONS

M. N. Desai et al, Werkstoffe Korrosion 14, 739–742 (1963) (Abstract).

M. N. Desai et al, J. Inst. Chem. Calcutta 1973, 45, Part IV, 135–137 (Abstract).

J. D. Talati et al, Vidya, 1969, 12(2), 182–192 (Abstract).

K. C. Koshel, Australas Corros. Eng., Aug. 1974, 18(8), 17–19 (Abstract).

J. D. Talati et al, Acta. Cienc. Indica., 1976, 2(3), 219–225 (Abstract).

S. M. Beloglazov, Uchenye Zapiski Permsk. Univ. 13, No. 3, 85–92 (1959) (Abstract).

Willibald Machu et al, Werkstoffe Korrosion 13, 745–752 (1962) (Abstract).

S. M. Beloglazov, Uch. Zap. Permsk. Gos. Univ. 19, No. 1, 37–41 (1961) (Abstract).

C. Cabrera et al, Cuba Azucar 1977, (Apr.–Jun.), 13–20 (Abstract).

C. Cabrera et al, Cuba Azucar 1976, (Jul.–Sep.), 20–26 (Abstract).

"Glue and Gelatin", by Paul I. Smith, Chemical Publishing Co., Inc. Brooklyn, N.Y. (1943) pp. 14 through 20.

*Primary Examiner*—Peter Hruskoci

*Attorney, Agent, or Firm*—Ernest G. Szoke; Henry E. Millson, Jr.; Real J. Grandmaison

[57] ABSTRACT

Corrosion inhibiting compositions for addition to aqueous acid metal cleaning compositions for use in the cleaning of surfaces of metal parts which are contaminated with water insoluble, acid soluble deposits, wherein the corrosion inhibiting composition contains a partially hydrolyzed protein which is either a partially hydrolyzed gelatin, a partially hydrolyzed casein or a mixture thereof wherein the partially hydrolyzed protein has a total nitrogen content of from about 10 to about 20% by weight and a free amino group nitrogen content of from about 4 to about 30% based on the total nitrogen content. The invention also relates to aqueous acid solutions containing the corrosion inhibitor of the invention and to processes for treating contaminated metal parts with such acid compositions.

6 Claims, No Drawings

CORROSION INHIBITED ACID CLEANERS

This application is a continuation of application Ser. No. 827,664, filed Feb. 7, 1986, now abandoned, which is a continuation of application Ser. No. 486,527, Apr. 19, 1983, now abandoned.

BACKGROUND OF THE INVENTION

Water wells containing potable water require periodic cleaning in order to remove scale from the well casings, well screens, pump bowls, etc. Typically, this scale is removed using an acid solution, generally a solution of hydrochloric acid. However, when such acid cleaning agents are used, several of the components forming the pumping mechanism are subject to attack by the acid, in particular, the well screen which is usually made of 304 stainless steel, the well casing which is usually made of mild steel, and especially the pump bowl which is usually cast iron. The hydrochloric acid is usually present in the cleaners in a concentration range of from 10 to 20% by weight which, upon repeated use, can be quite damaging to the above parts. In order to protect these parts from the acid during the cleaning cycle, inhibitors have been added to the acid cleaning mixtures. However, these inhibitors have generally been of two types, namely, a toxic inhibitor such as diethylthiourea or the nontoxic inhibitor gelatin, generally that manufactured under the tradename "Knox". The use of toxic inhibitors is, of course, quite undesirable, while the use of gelatin is also unsatisfactory due to the difficulty of dissolving the gelatin in the cold water and the fact that the gelatin may not properly protect the metal parts of the well and especially the cast iron pump bowl. There is therefore a compelling need for an inhibited acid solution for cleaning potable water wells in which the inhibitor is substantially nontoxic, effective, and readily soluble.

The use of proteins such as gelatin to inhibit the corrosion of metals in acid solution is well known; see, for example, M. N. Desai et al, Werkstoffe Korrosion 14, 739–42 (1963) which describes the use of gelatin to inhibit the organic acid corrosion of brass. M. N. Desai et al, J. Inst. Chem. Calcutta 1973, 45, Part IV, 135–7 describes the use of gelatin as an inhibitor to protect aluminum alloys against acetic acid and chloro-substituted acetic acids. J. D. Talati et al, Vidya, 1969, 12(2), 182–192 discloses the use of gelatin to reduce the corrosion of aluminum and aluminum magnesium alloys when exposed to organic acids. K. C. Koshel, Australas Corros. Eng., August 1974, 18(8), 17–19 describes the use of caseinium purum gelatin, etc., to prevent weight loss due to corrosion of aluminum in hydrochloric acid. J. D. Talati et al Acta. Cienc. Indica., 1976, 2(3), 219–225 describes the use of inhibitors such as gelatin to prevent the corrosion of aluminum alloys in chloroacetic acids.

A number of patents and publications describe the use of gelatin as an inhibitor against the corrosion attack by acids on iron or steel substrates. British No. 1,052,771 issued to Pyrene Company, Ltd. on Dec. 30, 1966 describes the use of gelatin with inorganic acids, such as phosphoric acid, to inhibit corrosion on iron or steel. S. M. Beloglazov, Uchenye Zapiski Permsk. Univ. 13, No. 3, 85–92 (1959) describes the use of inhibitors such as gelatin and casein to protect steel against sulfuric acid. Willibald Machu et al, Werkstoffe Korrosion, 13, 745–752 (1962) discloses the inhibition of acid corrosion in 1N sulfuric acid by the addition of gelatin to protect a number of metals including iron metals, S. M. Beloglazov, Uch. Zap. Permsk. Gos. Univ., 19, No. 1, 37–41 (1961) discloses the use of agents such as gelatin and casein in acid solutions to prevent hydrogenation and a change in fatigue strength of steel. C. Cabrera et al, Cuba Azucar, 1977 (April–June), 13–20 describes the use of both treated and untreated molasses to protect steel against corrosion during the acid cleaning thereof. C. Cabrera et al, Cuba Azucar, 1976 (July–September), 20–26 describes the use of distillery slops for preventing the acid corrosion of steel. The use of hydrolyzates of gelatin to protect certain metals from acid corrosion has also been described. For example, Shiga, Shoji, Japan. Kokai, No. 74 35 244, issued Apr. 1, 1974 describes the use of gelatin or its hydrolyzate to prevent the acid corrosion of copper zinc alloys. U.S. Pat. No. 3,505,184 issued Apr. 7, 1970 to Gilbert J. Schaedler et al describes the use of hydrolyzed protein as an inhibitor in a zinc electrodepositing bath. Japanese Patent No. 49,035,244 issued Jan. 4, 1974 discloses the use of gelatin or its hydrolyzate to prevent corrosion loss from copper zinc alloys. Czech. Application No. 153,709 published June 15, 1974 discloses the use of protein hydrolyzate to inhibit the corrosion of steel in 39% HCl.

DESCRIPTION OF THE INVENTION

The present invention relates to aqueous acid cleaning compositions which contain novel corrosion inhibiting materials for use in cleaning the surfaces of metal parts which are contaminated with water insoluble, acid soluble deposits. In particular, the invention relates to corrosion inhibiting materials which are hydrolyzed proteins, i.e. either a partially hydrolyzed gelatin, a partially hydrolyzed casein, or a mixture of these partially hydrolyzed proteins; and to aqueous acid cleaning composition containing these corrosion inhibitors, and to uses therefor.

The advantages of using the corrosion inhibitors of the invention are many. First of all, they are hydrolyzates of food proteins and are therefore physiologically safe and acceptable. Secondly, the corrosion inhibiting effect of these hydrolyzates is markedly superior to that of the same quantities of the unhydrolyzed proteins. Furthermore, these partial hydrolyzates exhibit significantly greater corrosion inhibiting effect than a similar quantity of these proteins which are hydrolyzed to a greater degree than those employed in the present invention. The reason why these partial hydrolyzates exhibit a greater corrosion inhibiting effect than either the unhydrolyzed protein or the more completely hydrolyzed protein is not understood, but the differences are significant and surprising. In addition, the present corrosion inhibitors are also much more water soluble than the unhydrolyzed proteins.

The aqueous acid cleaning compositions of the invention can be used for cleaning the surfaces of any metal parts or components which are contaminated with water insoluble, acid soluble deposits and the compositions of the invention accordingly have a broad range of uses. They are especially useful in industries where substantial lack of toxicity is of importance, such as for cleaning ferrous metal equipment and pieps that come into contact with foodstuffs. They are particularly suitable for the cleaning of metal components used in water wells, especially those containing potable water, i.e. they can be used to remove scale from well casings, well screens, pump bowls and other metal components commonly used in water wells. The present acid cleaning compositions are used in water wells by pumping the acid cleaning composition through the working parts of the well pump system until substantially all scale is removed from the metal parts thereof. Then pumping is continued using the fresh water that comes into the well from ground sources until all of the acid cleaning composition has been removed from the well.

The invention also relates to a solid corrosion inhibitor composition in finely divided form which can be added to aqueous acids which are formulated for use in removing such scale deposits. These solid corrosion inhibitor compositions of the invention contain A. from about 20 to about 50 wt. %, preferably from about 30 to about 40 wt. % of a partially hydrolyzed protein which is either a partially hydrolyzed gelatin, a partially hydrolyzed casein, or a mixture thereof, wherein the partially hydrolyzed protein has a total nitrogen content of from about 10 to about 20 wt. %, preferably from about 13 to about 17 wt. %, and a free amino group nitrogen content of from about 4 to about 30%, preferably from about 4.5 to about 21%, based on the total nitrogen content thereof;

B. from about 5 to about 29 wt. %, preferably from about 8 to about 15 wt. % of a surfactant;

C. from about 0 to about 60 wt. %, preferably from about 45 to about 55 wt. % of a water-soluble solid diluent.

Optionally, the solid corrosion inhibitor can also contain other ingredients such as, for example, from about 0.5 to about 5 wt. %, preferably from about 1 to about 3 wt. % of a dedusting agent, or other materials such as guar gum and the like.

The free amino group nitrogen content is a measure of the degree to which the protein has been hydrolyzed, i.e. a free amino group nitrogen content of about 30% means that the degree of hydrolysis is approximately 30%.

The surfactant can be a single surfactant or a combination of two or more surfactants, preferably solid surfactants. Preferred are those surfactants which are physiologically quite safe, such as DERIPHAT 160, a surfactant manufactured by Henkel Corporation of Minneapolis, Minn. which is disodium N-lauryl amino dipropionate. Other surfactants which are substantially nontoxic when used in accordance with the process of the invention, and which can be used alone or in combination, include DERIPHAT 151, DERIPHAT 160, DERIPHAT 154, and DERIPHAT 170, all manufactured by Henkel Corporation.

The water-soluble diluent, i.e. component C above, can be any nontoxic salt, either inorganic or organic, with which the other components of the solid corrosion inhibitor compositions are compatible, and which is also compatible with the aqueous acid to which the solid corrosion inhibitor is to be added. Examples of such nontoxic water-soluble solid diluents include sodium sulfate, sodium acetate, sucrose, fructose, glucose, sorbitol, other natural sugars, etc.

The dedusting agent which can be added as an optional ingredient can be any nontoxic water-soluble material known for its dedusting properties, such as compounds manufactured under the trademark TWEEN, such as TWEEN 80. The TWEEN's are manufactured by ICI of America, Inc. and are polyoxyethylene sorbitan monolaurates, monopalmitates, monostearates, monooleates, and tristearates and trioleates. TWEEN 80 is polyoxyethylene (20) sorbitan monooleate. Other dedusting agents that can be used include DERIPHAT 151C and DERIPHAT 160C, both manufactured by Henkel Corporation.

The aqueous acid cleaning compositions of the invention are most conveniently formulated by adding the above solid corrosion inhibitor composition to an aqueous acid in quantities sufficient to produce a corrosion inhibiting effect on the metal being treated with the aqueous acid solution. Normally the solid corrosion inhibitor is added in a quantity sufficient to give from about 1 to about 40 g/l, preferably from about 1 to about 5 g/l of the partially hydrolyzed protein to the resulting solution. Alternatively, the above quantities of partially hydrolyzed protein can be added alone to the aqueous acid. However, it is much preferred to add the solid corrosion inhibitor of the invention since this provides the hydrolyzed protein in a very convenient, easily measurable form and also insures rapid solution of the partially hydrolyzed protein, regardless of how cold the aqueous acid to which the hydrolyzed protein is added. The aqeuous acids which are used for cleaning metal include inorganic acids such as hydrochloric acid, which is normally present in about 10 to about 20% by weight, e.g. 15% by weight, as well as other inorganic acids, such as orthophosphoric acid. Organic acids are also used for this purpose, such as sulfamic acid, glycolic acid, and citric acid. Aqueous acid cleaning compositions containing the above inorganic and/or organic acids are also part of the present invention.

The metal parts which are contaminated with a water insoluble, acid soluble deposit can be treated by contacting them by any known method, such as by immersion, by spraying, or by pumping the aqueous acid solution containing the corrosion inhibitor of the invention through the parts to be cleaned. Usually the temperature of the aqueous acid cleaning composition during the cleaning operation is in the range of about 32° to about 90° F. and preferably in the range of about 40° to about 80° F. Contact time varies from about 1 to about 7 hours and is usually in the range of from about 3 to about 5 hours. Both temperature and contact time are, of course, somewhat dependent on the thickness of the water insoluble deposit being removed by the compositions and process of the invention. After treatment with the compositions and process of the invention, the metal parts are free of the water insoluble deposits.

The invention will be illustrated by the following examples which are given for this purpose only and not for purposes of limitation.

EXAMPLES 1-9

A solid mixture in finely divided form was prepared by mixing together the following ingredients:

| Ingredient | % by weight of mixture |
|---|---|
| Peter Cooper Refining Acid(1) | 36.3 |
| DERIPHAT 160(2) | 11.7 |
| TWEEN 80(3) | 2.0 |
| Sodium Sulfate | 50.0 |

(1)Peter Cooper Refining Acid (PCRA) is 90% gelatin hydrolysate having a total nitrogen content of 15.5-17 wt. % and a free amino group nitrogen content of 4.55%, based on the total nitrogen present. PCRA is a white, anhydrous free flowing powder.
(2)DERIPHAT 160 is a disodium n-lauryl amino dipropionate.
(3)TWEEN 80 is polyoxyethylene (20) sorbitan monooleate.

The above solid mixture was then added to separate portions of 15% (w/w) HCl in the concentrations set forth in Table I below. Clean 7 sq. in. metal coupons, of the metals shown in Table I, were immersed in each of the acid solutions and maintained in the solutions at 80° F. for 6 hours. The coupons were then removed from the solutions, rinsed with tap water, rinsed in acetone, air dried, and evaluated. The results obtained are given in Table I.

TABLE I

| Example | Solid mix. conc. g/l | Hydrolyzed gelatin content g/l | Initial wt., g. | Final wt., g. | Δ wt. | % wt. loss | % protection* |
|---|---|---|---|---|---|---|---|
| | | | 1010 Cold Rolled Steel | | | | |
| 1 | 1.2 | 0.4 | 17.6880 | 17.6544 | 0.0336 | 0.190 | 95.4 |
| 2 | 1.8 | 0.6 | 17.7044 | 17.6789 | 0.0255 | 0.144 | 96.5 |
| 3 | 2.4 | 0.8 | 17.5148 | 17.5000 | 0.0148 | 0.084 | 97.9 |
| 4 | 3.0 | 1.0 | 17.6871 | 17.6740 | 0.0131 | 0.074 | 98.2 |
| 5 | 3.6 | 1.2 | 17.5902 | 17.5778 | 0.0124 | 0.070 | 98.3 |
| 6 | 4.2 | 1.4 | 17.6202 | 17.6070 | 0.0132 | 0.075 | 98.2 |
| 7 | 4.8 | 1.6 | 17.4554 | 17.4410 | 0.0144 | 0.082 | 98.0 |
| 8 | 5.4 | 1.8 | 17.6350 | 17.6199 | 0.0151 | 0.086 | 97.9 |
| 9 | 6.0 | 2.0 | 17.8117 | 17.7954 | 0.0163 | 0.092 | 97.8 |
| 10 | 12.0 | 3.9 | | | | | |
| 11 | 24.0 | 7.8 | | | | | |
| 12 | 36.0 | 11.8 | | | | | |
| Control | — | — | 17.7620 | 17.0358 | 0.7262 | 4.089 | 00.0 |
| | | | 304 Stainless Steel | | | | |
| 1 | 1.2 | 0.4 | 13.5823 | 13.5740 | 0.0083 | 0.061 | 85.2 |
| 2 | 1.8 | 0.6 | 13.5631 | 13.5570 | 0.0061 | 0.045 | 89.1 |
| 3 | 2.4 | 0.8 | 13.8485 | 13.8414 | 0.0071 | 0.051 | 87.6 |
| 4 | 3.0 | 1.0 | 13.4770 | 13.4698 | 0.0072 | 0.053 | 87.1 |
| 5 | 3.6 | 1.2 | 13.8474 | 13.8422 | 0.0052 | 0.038 | 90.8 |
| 6 | 4.2 | 1.4 | 13.7852 | 13.7808 | 0.0044 | 0.032 | 92.2 |
| 7 | 4.8 | 1.6 | 13.7410 | 13.7360 | 0.0050 | 0.036 | 91.2 |
| 8 | 5.4 | 1.8 | 13.5705 | 13.5668 | 0.0037 | 0.027 | 93.4 |
| 9 | 6.0 | 2.0 | 14.0255 | 14.9199 | 0.0056 | 0.040 | 90.3 |
| 10 | 12.0 | 3.9 | | | | | |
| 11 | 24.0 | 7.8 | | | | | |
| 12 | 36.0 | 11.8 | | | | | |
| Control | — | — | 14.1823 | 14.1240 | 0.0583 | 0.411 | 00.0 |
| | | | Cast Iron | | | | |
| 1 | 1.2 | 0.4 | 63.9824 | 59.0866 | 4.8958 | 7.652 | 36.8 |
| 2 | 1.8 | 0.6 | 62.9172 | 57.5048 | 4.5124 | 7.276 | 39.9 |
| 3 | 2.4 | 0.8 | 61.8269 | 57.9500 | 3.8769 | 6.271 | 48.2 |
| 4 | 3.0 | 1.0 | 62.7492 | 59.3515 | 3.3977 | 5.415 | 55.3 |
| 5 | 3.6 | 1.2 | 64.6000 | 61.6996 | 2.9004 | 4.490 | 62.9 |
| 6 | 4.2 | 1.4 | 63.7871 | 61.6599 | 2.1272 | 3.335 | 72.5 |
| 7 | 4.8 | 1.6 | 62.3915 | 60.5715 | 1.9200 | 3.077 | 74.6 |
| 8 | 5.4 | 1.8 | 61.5056 | 59.7647 | 1.7409 | 2.830 | 76.6 |
| 9 | 6.0 | 2.0 | 60.6367 | 59.7799 | 0.8568 | 1.413 | 88.3 |
| 10 | 12.0 | 3.9 | | | | | |
| 11 | 24.0 | 7.8 | | | | | |
| 12 | 36.0 | 11.8 | | | | | |
| Control | — | — | 63.4380 | 55.7544 | 7.6836 | 12.112 | 0.00 |

*% protection is calculated as $\frac{\text{\% weight loss uninhibited} - \text{\% weight loss inhibited}}{\text{\% weight loss uninhibited}} \times 100$ As can be seen from the above TABLE I, while a level of hydrolyzed gelatin in accordance with the invention below 1 g/l is effective for cold rolled steel and stainless steel, such levels do not give satisfactory protection for cast iron.

EXAMPLES 13–42

A number of single materials and combinations of materials were added to separate quantities of 15% (w/w) HCl and metal coupons of 7 sq. in. size were immersed in the resulting solutions for 6 hours at 80° F. The results obtained for metal loss were then calculated to give the number of pounds of metal loss per square foot of metal surface in a 24 hour period, in order to arrive at a standard figure for comparison purposes. The results obtained are given in TABLE II below.

TABLE II

| Example | Substance tested, g/l in 15% (w/w) HCl | 1010 Cold Rolled Steel Weight loss, lb/ft²/24 hrs. | 1010 Cold Rolled Steel % protection | 304 Stainless Steel Weight loss, lb/ft²/24 hrs. | 304 Stainless Steel % protection | Cast Iron Weight loss, lb/ft²/24 hrs. | Cast Iron % protection |
|---|---|---|---|---|---|---|---|
| 13 | 3.6 EHC(4) | 0.0084 | 93 | 0.0019 | 92 | 0.3736 | 70 |
| 14 | 3.6 PCRA(5) | 0.0193 | 84 | 0.0025 | 90 | 0.4040 | 68 |
| 15 | 1.45 PCRA | 0.0210 | 82 | 0.0026 | 89 | 0.4949 | 60 |
| 16 | 3.6 Knox gelatin | 0.0252 | 79 | 0.0045 | 82 | 0.7772 | 35 |
| 17 | 3.6 PCS-1 gelatin(6) | 0.0223 | 82 | 0.0039 | 84 | 0.7858 | 38 |
| 18 | 3.6 Purified gelatin | 0.0095 | 92 | 0.0020 | 91 | 0.8129 | 34 |
| 19 | 2.15 PCS-1 gelatin | 0.0221 | 82 | 0.0020 | 91 | 0.6659 | 53 |
| 20 | 2.0 PCS-A(7) | 0.0022 | 91 | 0.0224 | 81 | 0.8213 | 36 |
| 21 | 1.75 PCS-5A(8) | 0.0181 | 85 | 0.0024 | 91 | 0.8528 | 31 |
| 22 | 0.75 PCRA<br>0.40 EHC | 0.0175 | 86 | 0.0022 | 92 | 0.5063 | 61 |
| 23 | 0.75 PCRA<br>1.40 TWEEN 80 | 0.0191 | 84 | 0.0030 | 88 | 0.4334 | 66 |

TABLE II-continued

| Example | Substance tested, g/l in 15% (w/w) HCl | 1010 Cold Rolled Steel Weight loss, lb/ft²/24 hrs. | 1010 Cold Rolled Steel % protection | 304 Stainless Steel Weight loss, lb/ft²/24 hrs. | 304 Stainless Steel % protection | Cast Iron Weight loss, lb/ft²/24 hrs. | Cast Iron % protection |
|---|---|---|---|---|---|---|---|
| 24 | 0.75 PCRA<br>1.35 guar gum | 0.0122 | 90 | 0.0022 | 91 | 0.5520 | 61 |
| 25 | 0.40 EHC<br>1.40 TWEEN 80 | 0.0195 | 84 | 0.0024 | 90 | 0.6866 | 45 |
| 26 | 0.40 EHC<br>1.35 guar gum | 0.0108 | 91 | 0.0016 | 93 | 0.8380 | 21 |
| 27 | 0.50 PCRA<br>0.25 EHC<br>0.95 TWEEN 80 | 0.0195 | 84 | 0.0023 | 90 | 0.4084 | 67 |
| 28 | 0.25 EHC<br>0.95 TWEEN 80<br>0.90 guar gum | 0.0172 | 73 | 0.0018 | 92 | 0.7716 | 38 |
| 29 | 0.50 PCRA<br>0.95 TWEEN 80<br>0.90 guar gum | 0.0193 | 84 | 0.0021 | 92 | 0.4811 | 61 |
| 30 | 0.50 PCRA<br>0.25 EHC<br>0.90 guar gum | 0.0120 | 90 | 0.0023 | 91 | 0.5581 | 55 |
| 31 | 0.35 PCRA<br>0.20 EHC<br>0.65 guar gum<br>0.70 TWEEN 80 | 0.0156 | 87 | 0.0059 | 77 | 0.5094 | 59 |
| 32 | 0.65 PCRA<br>1.25 TWEEN 80<br>0.40 DERIPHAT 160C | 0.0103 | 91 | 0.0034 | 86 | 0.4730 | 67 |
| 33 | 0.45 PCRA<br>0.25 EHC<br>0.85 TWEEN 80<br>0.40 DERIPHAT 160C | 0.0112 | 91 | 0.0031 | 87 | 0.5062 | 65 |
| 34 | 0.65 PCRA<br>1.25 TWEEN 80<br>0.10 DERIPHAT 160 | 0.0132 | 89 | 0.0034 | 86 | 0.4925 | 60 |
| 35 | 0.45 PCRA<br>0.25 EHC<br>0.85 TWEEN 80<br>0.10 DERIPHAT 160 | 0.0125 | 90 | 0.0027 | 89 | 0.5997 | 52 |
| 36 | 0.60 PCRA<br>1.70 TWEEN 80 | 0.0159 | 87 | 0.0033 | 87 | 0.3995 | 71 |
| 37 | 0.95 PCRA<br>0.95 TWEEN 80 | 0.0157 | 87 | 0.0030 | 88 | 0.3935 | 69 |
| 38 | 1.25 PCRA<br>0.40 TWEEN 80 | 0.0148 | 88 | 0.0030 | 88 | 0.4095 | 71 |
| 39 | 0.75 PCRA<br>0.60 DERIPHAT 160 | 0.0021 | 98 | 0.0010 | 96 | 0.4171 | 66 |
| 40 | 1.05 PCRA<br>0.35 DERIPHAT 160 | 0.0032 | 97 | 0.0014 | 94 | 0.4307 | 66 |
| 41 | 0.65 PCRA<br>0.65 DERIPHAT 160 | 0.0030 | 98 | 0.0013 | 95 | 0.5732 | 53 |
| 42 | 0.30 PCRA<br>0.95 DERIPHAT 160 | 0.0052 | 97 | 0.0017 | 93 | 0.8518 | 31 |

(4)EHC is an enzyme hydrolyzed casein in the form of an anhydrous powder having a total nitrogen content of 13.5 wt. %, and a free amino group nitrogen content of 30.0%, based on total nitrogen content. The product used was manufactured by Amber Laboratories of Milwaukee, Wisconsin under the trade name AMBER EHC.

(5)PCRA is Peter Cooper's Refining Aid, a white powder containing 90% gelatin hydrolyzate having a total nitrogen content of 15.5–17 wt. %, and a free amino group nitrogen content of 4.55% based on total nitrogen content. This product was manufactured by Peter Cooper Corporation of Gowanda, NY. The quantity of hydrolyzed gelatin actually present in PCRA is the number of grams per liter of PCRA multiplied by 0.9.

(6)PCS-1 gelatin is a hydrolyzed gelatin normally used as a glue and having a total nitrogen content of 15.5–17 wt. % and a free amino group nitrogen content of 0.6%.

(7)PCS-A is a hydrolyzed gelatin normally used as a glue and having a total nitrogen content of 15.5–17 wt. % and a free amino group nitrogen content of 1.4%.

(8)PCS-5A is a hydrolyzed gelatin normally used as a glue and having a total nitrogen content of 15.5–17 wt. % and a free amino group nitrogen content of 1.0%.

The above TABLE II shows that unhydrolyzed proteins such as gelatin as well as proteins hydrolyzed to a lesser degree than EHC and PCRA give a much lower percent protection of cast iron than EHC and PCRA, even when EHC and PCRA are used (alone or in mixtures with each other and/or other ingredients) in significantly smaller quantities than the comparison products.

What is claimed is:

1. A method for removing a water insoluble, acid soluble deposit from the surfaces of a metal part contaminated therewith, wherein said metal part is made of steel or cast iron, comprising, contacting said metal part with an aqueous acid cleaning composition comprising (a) about 10 to about 20% by weight hydrochloric acid present in a quantity sufficient to remove said water insoluble, acid soluble deposit from the surfaces of metal parts; and (b) a corrosion inhibiting concentration of a partially hydrolyzed protein selected from the group consisting of a partially hydrolyzed gelatin, a partially hydrolyzed casein, and a mixture thereof, wherein the partially hydrolyzed protein has a total nitrogen content of from about 13 to about 17% by weight, and a free amino group nitrogen content of from about 4.5 to about 21%, based on the total nitrogen content thereof.

2. A method in accordance with claim 1 wherein said composition also contains at least one of the following:

(c) a surfactant (d) a dedusting agent (e) a water soluble inorganic salt.

3. A method in accordance with claim 1 wherein the partially hydrolyzed protein in (b) is present in the aqueous cleaning composition in a quantity of from about 1 to about 40 g/l.

4. A method in accordance with claim 3 wherein the quantity is from about 1 to about 5 g/l.

5. A method in accordance with claim 1 wherein the temperature of the aqueous acid cleaning composition is in the range of from about 32° to about 90° F.

6. A method in accordance with claim 5 wherein the temperature is in the range of from about 40° to about 80° F.

* * * * *